US005581962A

United States Patent [19]

Davis et al.

[11] Patent Number: 5,581,962

[45] Date of Patent: Dec. 10, 1996

[54] ANTENNA MAST AND SUPPORT STRUCTURE

[75] Inventors: Lawrence A. Davis, Moore, Okla.; Billy R. Byer, Jackson, Miss.

[73] Assignee: Alternative Attachments, Inc., Moore, Okla.

[21] Appl. No.: 390,639

[22] Filed: Feb. 17, 1995

[51] Int. Cl.[6] ..... H01Q 21/00; E04H 12/00

[52] U.S. Cl. ..... 52/148; 343/890; 52/152; 52/151; 52/155

[58] Field of Search ..... 248/511, 519; 52/148, 146, 152, 151, 155; 343/890, 874, 880

[56] References Cited

U.S. PATENT DOCUMENTS

| | | | |
|---|---|---|---|
| 1,721,101 | 7/1929 | Blaisdell | 343/890 X |
| 1,981,339 | 11/1934 | Vrooman | 343/890 X |
| 2,351,275 | 6/1944 | McConnel | 52/148 X |
| 2,581,351 | 1/1952 | Black | 52/148 |
| 2,683,615 | 7/1954 | Holt | 52/148 X |
| 2,799,369 | 7/1957 | Walton | 52/151 |
| 2,888,111 | 5/1959 | Evans | 52/148 X |
| 3,358,952 | 12/1967 | Burns | 343/890 X |
| 3,605,359 | 9/1971 | Bader et al. | 52/146 |
| 4,317,122 | 2/1982 | Ben-Don | 343/890 X |
| 5,339,847 | 8/1994 | Kanter et al. | 52/152 X |

*Primary Examiner*—Wynn E. Wood

*Attorney, Agent, or Firm*—Dougherty, Hessin, Beavers & Gilbert

[57] ABSTRACT

An antenna support consisting of a mast resting on a mast plate adjacent a building and including an adjustable length wall bracket secured to the building and bracketed to the mid-section of the mast, a guy arm secured to the mast and extending about 180° from the wall bracket, a bowed guy wire connected from the antenna mast top through the guy arm to the mast plate, and two or more guy wires connected in spread array between the mast top and the adjacent building.

8 Claims, 2 Drawing Sheets

ANTENNA MAST AND SUPPORT STRUCTURE

BACKGROUND OF THE INVENTION

1. Field of the Invention

The invention relates generally to ancillary support structure for use in positioning and guying selected heights of antenna masts.

2. Description of the Prior Art

The prior art is largely confined to the older types of antennae and antenna masts and quadrature guying structure as supported either in open ground or from atop a building structure. Such prior devices consisted of extremely heavy and unyielding base support devices or extensive guying devices that interfered to a great degree with ground activity. New and to a great degree miniaturized antenna assemblies, particularly parabolic dish and other ultra high frequency (UHF) antennae, have given rise to new modes of antenna support structure.

SUMMARY OF THE INVENTION

The present invention relates to an improved type of antenna support structure that is directed to more compact mast implements utilizing novel support structure. The antenna mast is characterized by shorter structure having greater rigidity which utilizes a ground to mast plate for earthen support as well as an adjustable wall bracket that clamps to the mast for securement at an adjacent wall surface. In the opposite or outward direction, the antenna mast supports a bowed guy arm which enables guy wire retention from the top of the mast downward to the base of the mast while the opposite side of the antenna is supported by two or more guy wires mounted in spread angle to tie to adjacent roof or exterior wall facing structure.

Therefore, it is an object of the present invention to provide antenna mast guying structure having minimal surface contact.

It is also an object of the invention to provide more rigid mast structure for supporting small diameter VHF/UHF parabolic antennae.

It is still further an object of the present invention to provide a rigid antenna that may be adjustably braced at a selected distance from a supporting building.

Finally, it is an object of the present invention to provide a combination of novel antenna support implements that enable more rugged and reliable antenna support.

Other objects and advantages of the invention will be evident from the following detailed description when read in conjunction with the accompanying drawings which illustrate the invention.

DETAILED DESCRIPTION OF THE INVENTION

Figure 1:
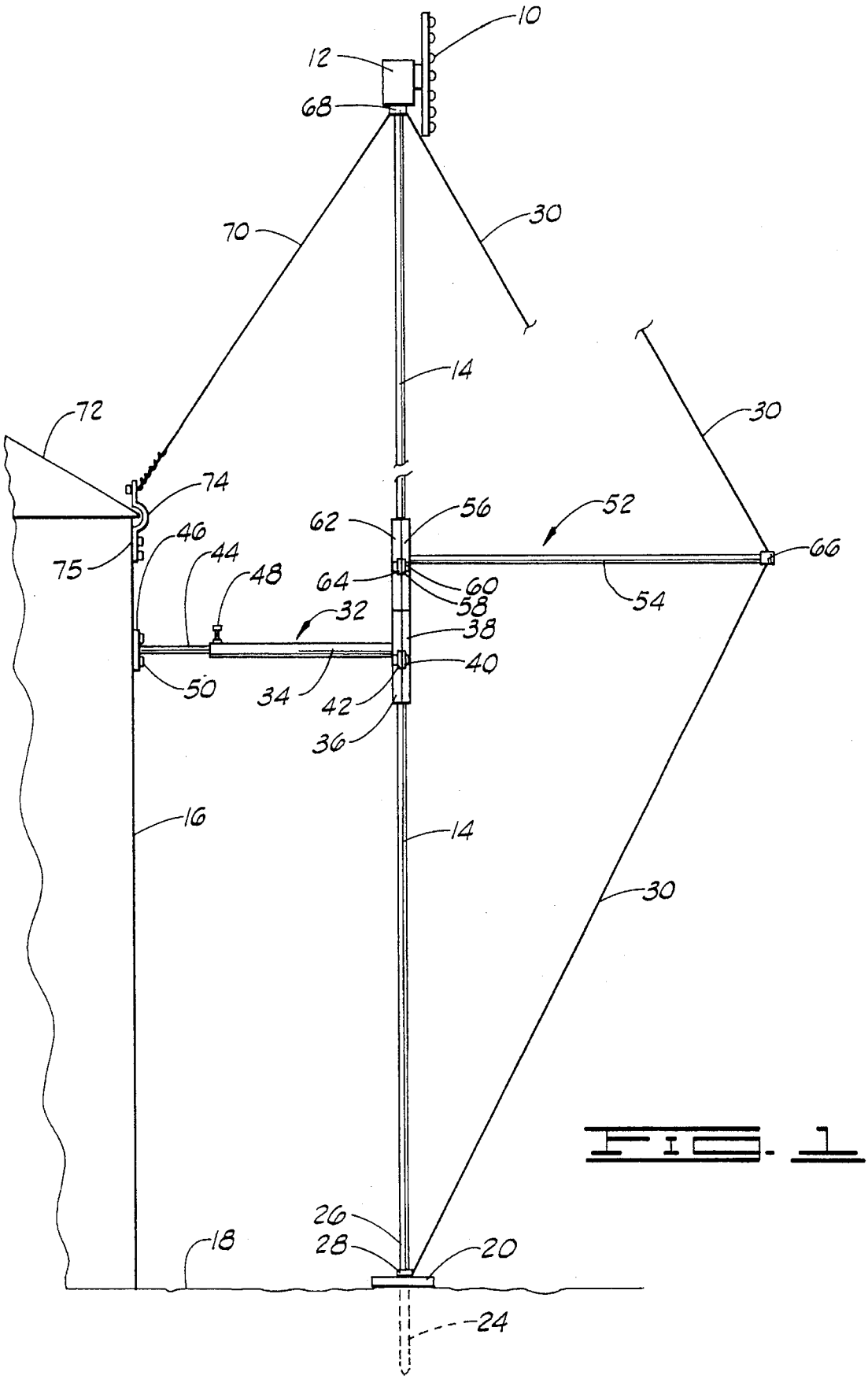
FIG. 1 is a view in elevation of one type of antenna installation illustrating the invention.
Figure 3A:
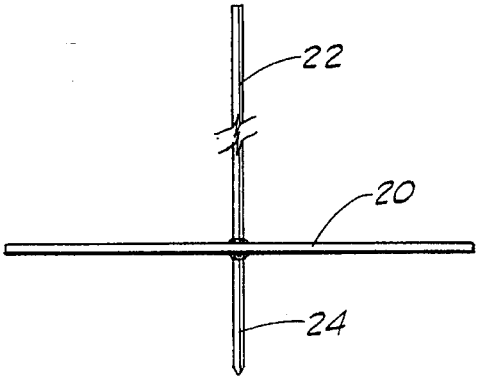
FIG. 3A is a side elevation of a ground to mast plate utilizing the present invention.
Figure 3B:
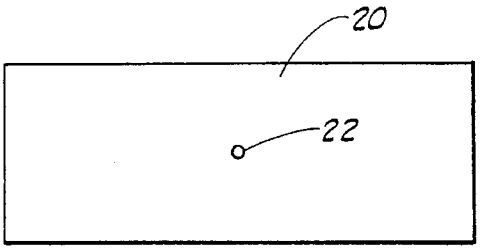
FIG. 3B is a top plan view of FIG. 3A.

Referring to FIG. 1, a receiving antenna 10 supported with a control box 12 is secured on an antenna mast 14 that is positioned at a selected rotation adjacent a building 16. The antenna mast 14 is supported vertically on the earthen ground 18 by means of a ground to mast plate 20, shown also in FIGS. 3A and 3B. The plate 20 may be formed of suitable rectangular or square shape while including a mast rod 22 mounted on the top side center and a ground spike 24 secured as by welding to the bottom side center. The rod ends 22 and 24 may be formed from a single piece of rod stock which is welded through a central hole in the mast plate 20. Thereafter, it is only necessary to sharpen the lower end of ground rod 24 to aid in ground insertion.

The mast 14, preferably formed of rigid pipe stock, is supported on ground to mast plate 20 by inserting the bottom end 26 of mast 14 down over the rod 22 of the ground to mast plate 20. A suitable bracket 28 may be locked in place adjacent the upper surface of ground to mast plate 20 to provide a surface or eye for fixture of the downward fall of a guy wire 30, as will be further described.

The intermediate portion of mast 14 is supported adjacent the building 16 by an adjustable wall bracket 32. See also FIGS. 4A and 4B. The adjustable wall bracket 32 consists of a sleeve 34, on the order of two feet in length, which is secured as by welding to the outer corner of an angle section 36, e.g., a section of angle iron of approximately twelve inches in length. An opposite clamping angle section 38 (FIG. 4B) is provided as opposite angle ear tabs 40 and 42 are secured as by welding on opposite sides of respective angle sections 38 and 36 to provide bolt securing holes.

The angle irons forming angle sections 38 and 36 are of a size that assures tight clamp fitting around the circumference of mast 14 to direct sleeve 34 toward the house or building 16. An entry rod 44, approximately two feet in length, having securing plate 46 welded across the outer end, is then inserted in sleeve 34 and secured by means of a clamping screw 48 to extend the required distance from mast 14 to building 16. The screw fasteners 50 then secure the wall bracket 32 to the building 16 to provide stable upright support to the mast 14.

Figure 4B:
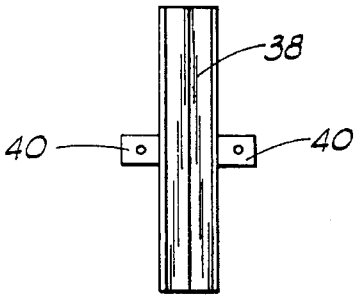
FIG. 4B is a plan view in elevation of an outer clamp plate of the adjustable wall bracket of FIG. 4A.
Figure 4A:
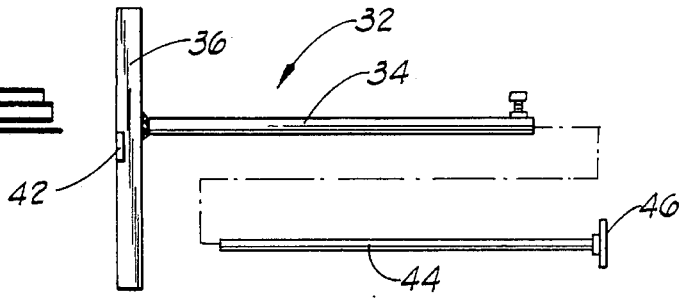
FIG. 4A is a side view in elevation, shown in exploded form, of an adjustable wall bracket of the invention.
Figure 5:
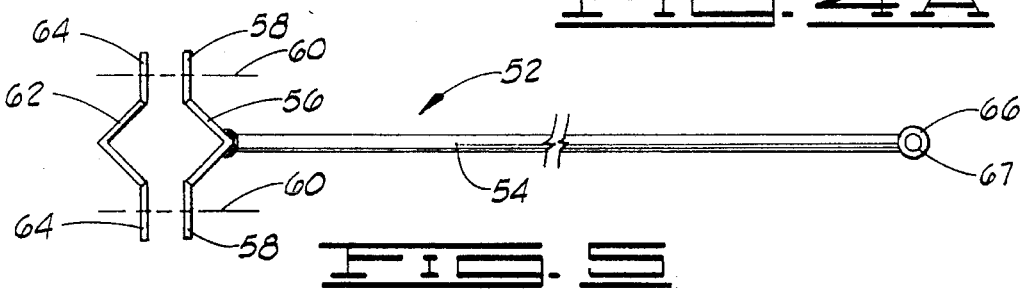
FIG. 5 is a top plan view of a guy arm with brackets as utilized in the present invention.

A guy arm 52 is also secured to mast 14 at an intermediate position to provide outer support to guy wire 30 to offset the two or more inner guys, as will be described. See also FIG. 5. The guy arm 52 is supported by means of a suitable angle bracket assembly as guy rod 54 is welded to the outer corner of an angle bracket 56 and opposite securing tabs 58 are welded in alignment to receive fasteners 60. A mating bracket is formed from a section of angle iron as angle section 62 having opposite side securing tabs 64. The angle sections 56 and 62 may be on the order of 18 inches in length and formed of angle stock similar to that of angle brackets 36 and 38 (FIGS. 4A and 4B). Thus, the angles 56 and 62 are capable of being tightly secured on mast 14 while extending the guy arm 54 outward. The outer end of guy arm 54 includes a guy ring or guide 66 which may be a suitable ring, e.g., a one inch section of pipe, secured as by welding to the end of guy arm 54. It is also desirable to provide a slant cut Z-slat 67 in the end of guide 66 to enable easier rigging of guy wire 30.

Figure 2A:
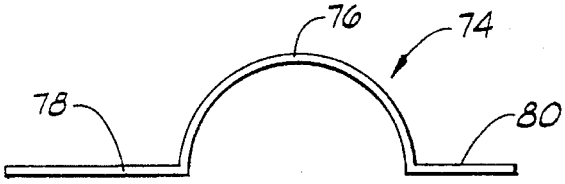
FIG. 2A is a view in side elevation of a guy anchor constructed in accordance with the invention.
Figure 2B:
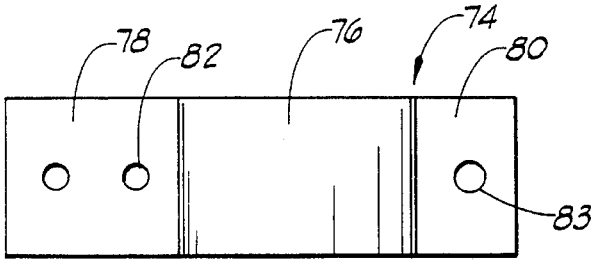
FIG. 2B is a plan view of FIG. 2A.

The front or outside of antenna mast 14 is held firm by the single guy wire 30, bow-rigged as shown in FIG. 1, with the lower end bracketed at mast plate 20 and leading up through guy arm guy ring 66 to a securing bracket 68 secured atop mast 14 beneath the antenna control box 12. The rear side of mast 14 is steadied from the upper end by two or more guy wires 70 that lead down to positions adjacent roof 72 for fixture to a guy anchor 74 secured on the eave facer board 75. See also FIGS. 2A and 2B. Guy anchor 74 is formed with semi-circular (or other convenient curve) mid-section 76 having opposite end bent tab sections 78 and 80 that have two securing holes 82 formed to receive securing fasteners therethrough, and a single securing hole 83 for anchoring the respective guy wire 70. The securing tab end 78 receiving maximum stress would generally have the double securing hole 82 configuration.

The rearward guy wires 70, whether an array of two wires or more, must be arranged in a balanced, spread array offsetting toward the single bow-aligned guy wire 30. The guy anchors 74 may be placed vertically on the facer board 75 of building 16 or they may be suitably positioned on the roof 72 so long as the guy wires 70 are spread at sufficient angle to top mast securing bracket 68.

The foregoing discloses a novel antenna rigging that may be quickly and reliable installed and which utilizes ground surface bracing with minimal interference to ground activity. The lateral bracing elements are adapted for use with a generally heavier mast structure, as is usually required by the recently developed VHF/UHF antennae, i.e., the smaller dipole or fan-type and reduced diameter parabolic dish receiver antennas.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. An antenna support for use in coaction with an adjacent building structure, comprising:

an elongate vertical mast having top, bottom and mid-sections;

a mast plate secured to said mast and secured in contact with the ground surface adjacent said building structure;

an adjustable length wall bracket secured between said mast mid-section and said building structure to maintain said mast in vertical attitude;

an elongate guy arm secured to said mast mid-section proximate said wall bracket and extending an outward end in the opposite direction from the wall bracket;

a first guy wire connected tautly from said mast top through said guy arm outward end to said mast bottom; and at least two spaced second guy wires connected tautly from said mast top to said building structure.

2. An antenna support as set forth in claim 1 wherein said mast plate comprises:

a generally rectangular plate disposed for ground surface contact;

an upper means secured centrally on said plate to provide secure affixture to said mast bottom; and a lower means secured centrally on said plate underside to provide secure engagement with said ground surface.

3. An antenna support as set forth in claim 1 wherein said wall bracket comprises:

an end bracket for removable securing around said mast;

a sleeve secured to extend at ninety degrees from said end bracket;

an extension rod having an outer end slidably disposed in said sleeve;

a clamping screw disposed on said sleeve outer end for securing said extension rod; and a securing plate affixed across the extension rod outer end.

4. An antenna support as set forth in claim 2 wherein said wall bracket comprises:

an end bracket for removable securing around said mast;

a sleeve secured to extend at ninety degrees from said end bracket;

an extension rod having an end slidably disposed in said sleeve;

a clamping screw disposed on said sleeve outer end for securing said extension rod; and a securing plate affixed across the extension rod outer end.

5. An antenna support as set forth in claim 1 wherein said guy arm comprises:

a guy arm end bracket for removable securing around said mast; and a guide ring secured to said guy arm outward end to receive said first guy wire therethrough.

6. An antenna support as set forth in claim 2 wherein said guy arm comprises:

a guy arm end bracket for removable securing around said mast; and a guide ring secured to said guy arm outward end to receive said first guy wire therethrough.

7. An antenna support as set forth in claim 3 wherein said guy arm comprises:

a guy arm end bracket for removable securing around said mast; and a guide ring secured to said guy arm outward end to receive said first guy wire therethrough.

8. An antenna support as set forth in claim 4 wherein said guy arm comprises:

a guy arm end bracket for removable securing around said mast; and a guide ring secured to said guy arm outward end to receive said first guy wire therethrough.

* * * * *